US005957316A

United States Patent [19]

Hidding et al.

[11] Patent Number: 5,957,316

[45] **Date of Patent: *Sep. 28, 1999**

[54] VALVED BOTTLE CAP

[76] Inventors: Walter E. Hidding, 367A Woodrock Rd., Barrington Hills; Douglas J. Hidding, 801 E. Lake Shore Dr., Barrington, both of Ill. 60010; Robert D. Hidding, 38W191 Binnie Lakes Trail, West Dundee, Ill. 60118

[ * ] Notice: This patent is subject to a terminal disclaimer.

[21] Appl. No.: 08/774,246

[22] Filed: Aug. 5, 1996

Related U.S. Application Data

[63] Continuation-in-part of application No. 08/325,005, Dec. 27, 1994, Pat. No. 5,542,555, which is a continuation of application No. 07/995,004, Oct. 1, 1992, Pat. No. 5,392,939.

[51] Int. Cl.[6] ..... B65D 51/18

[52] U.S. Cl. ..... 215/265; 215/303; 141/363; 141/348; 141/351

[58] Field of Search ..... 215/227, 264, 215/265, 267, 303; 141/18, 330, 346, 363, 348, 351

[56] References Cited

U.S. PATENT DOCUMENTS

| | | | |
|---|---|---|---|
| 5,031,676 | 7/1991 | Ulm | 141/346 |
| 5,095,962 | 3/1992 | Lloyd-davies et al. | 141/346 |
| 5,222,530 | 6/1993 | Baker et al. | 215/253 X |
| 5,259,534 | 11/1993 | Lynd | 141/346 X |
| 5,273,083 | 12/1993 | Burrows | 141/18 |
| 5,392,939 | 2/1995 | Hidding et al. | 215/265 |
| 5,467,806 | 11/1995 | Stricklin et al. | 141/346 |
| 5,542,555 | 8/1996 | Hidding et al. | 215/265 |
| 5,609,195 | 3/1997 | Stricklin et al. | 141/346 |
| 5,647,416 | 7/1997 | Desrosiers et al. | 141/18 X |

*Primary Examiner*—Stephen K. Cronin
*Assistant Examiner*—Nathan Newhouse
*Attorney, Agent, or Firm*—Baker & McKenzie

[57] ABSTRACT

A cap for use with a dispensing system. The cap includes a main outer cap and an inner cap. The main outer cap has a central sleeve which receives and seals against a probe. The inner cap moves into and out of a sealing engagement with the central tube as the bottle is raised and lowered over the probe. The seal between the inner cap and the central tube is located on the outside surface of the central tube. The location of the connection between the inner cap and the probe is displaced away from the location of the connection between the inner cap and the sleeve of the main outer cap. This allows the cap to have effective differentials between the forces which are necessary to achieve proper sequencing of the formation of the various seals and connections which occur during use of the cap.

13 Claims, 5 Drawing Sheets

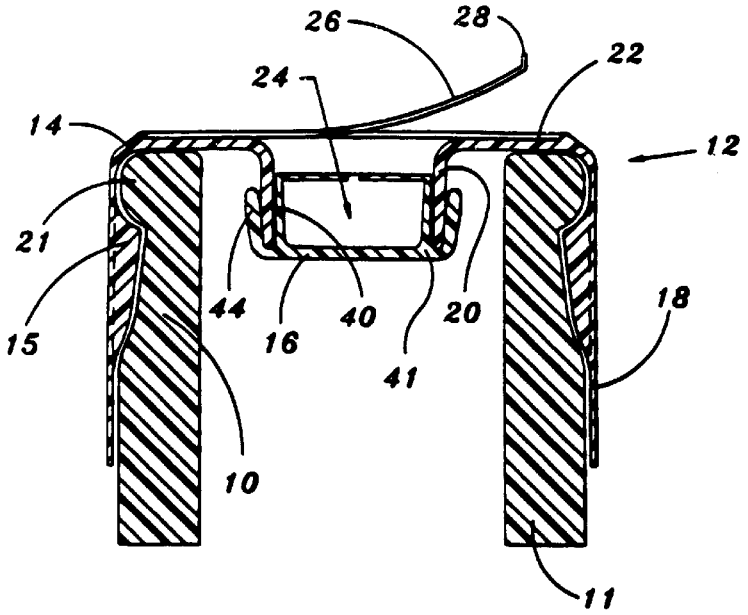
Fig. 1
Fig. 2
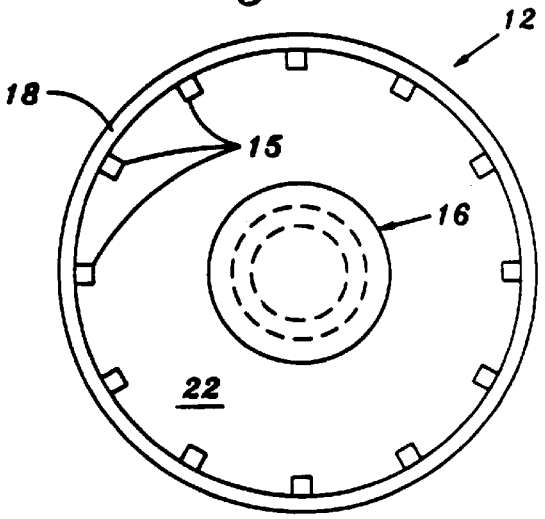
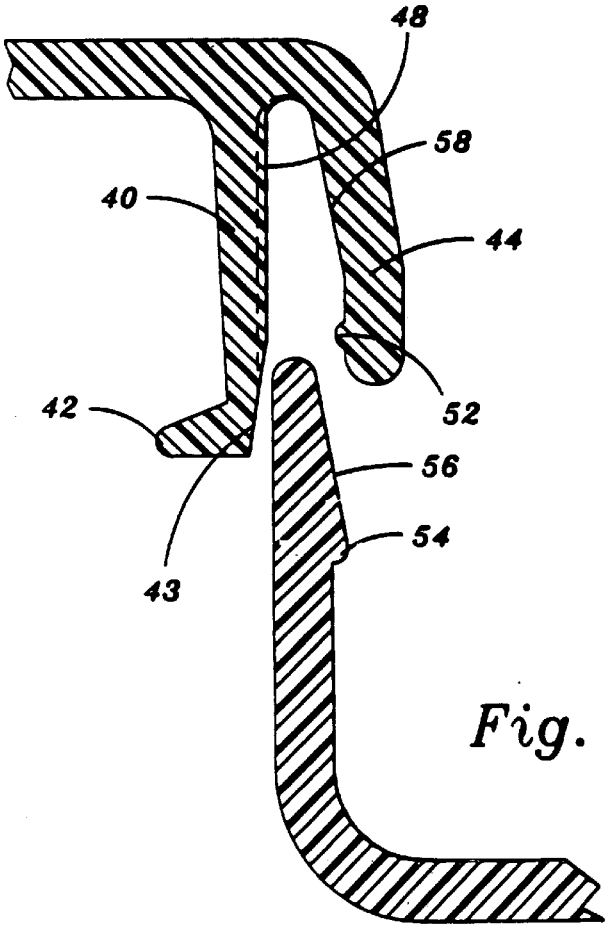
Fig. 3

Fig. 7
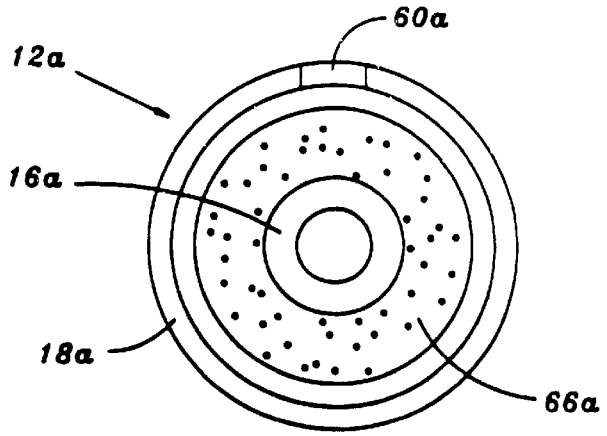
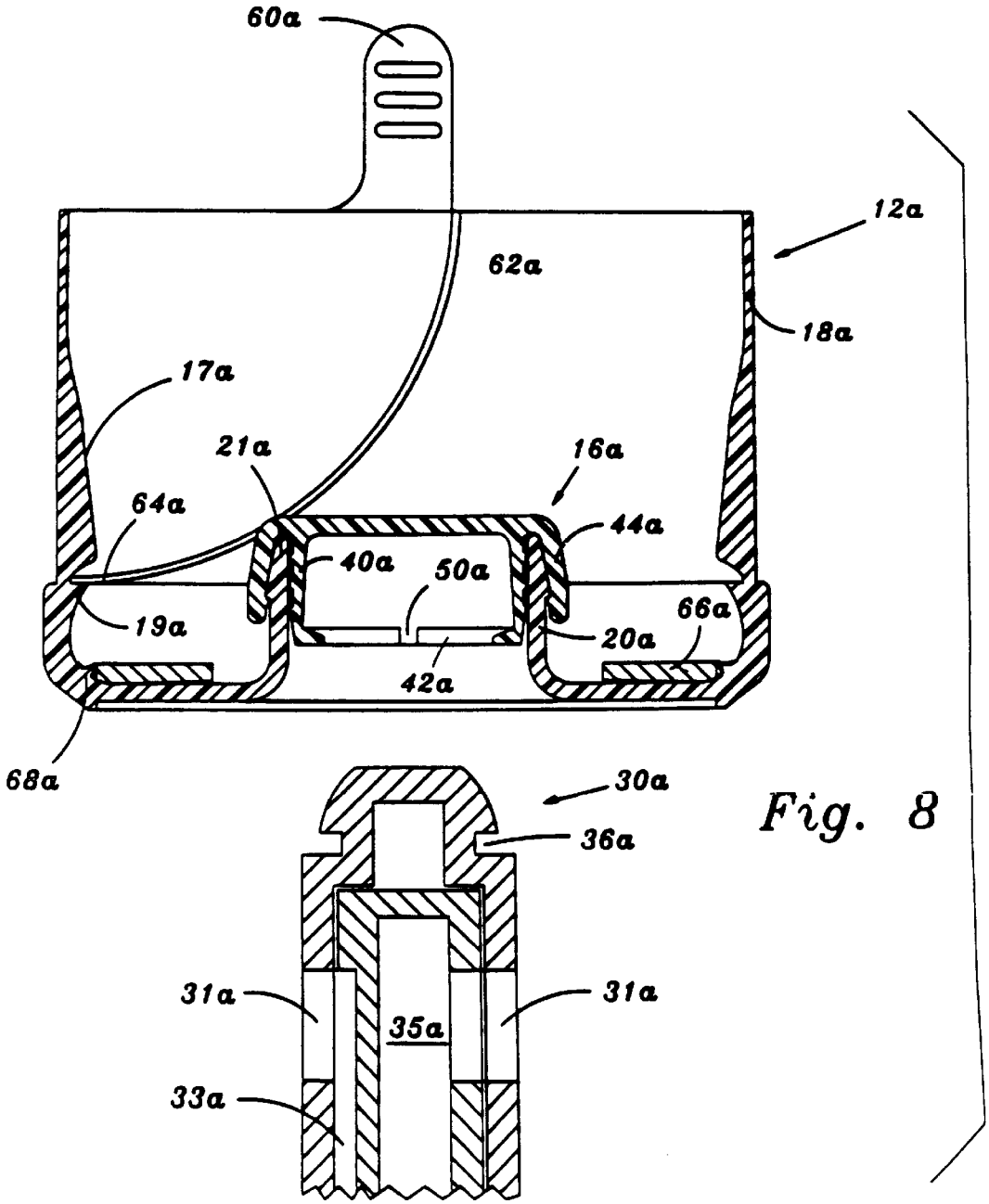
Fig. 8

VALVED BOTTLE CAP

This is a continuation-in-part of application Ser. No. 08/325,005, filed Dec. 27, 1994, which issued as U.S. Pat. No. 5,542,555 on Aug. 6, 1996, which was a continuation of spplication Ser. No. 07/995,004, filed Oct. 1, 1992, which issued as U.S. Pat. No. 5,392,939 on Feb. 28, 1995.

BACKGROUND AND SUMMARY OF THE INVENTION

The present invention relates generally to bottle caps which form closures on containers from which liquid and dry materials are dispensed.

Dispensing systems such as those used on water coolers which use bottled water, like the one shown in U.S. Pat. No. 5,121,778 (the "'778 patent"), are generally equipped with reservoirs. The reservoirs are kept filled with water supplied by an inverted large capacity water bottle. The capacity of such water bottles is typically five or six gallons, although containers of other capacities are also used.

In recent years, water cooler manufacturers have addressed problems with traditional water cooler systems. Those problems include the difficulty of inverting an open water bottle, and concerns relating to the growth of bacteria in the reservoirs resulting from exposure of the reservoir to the atmosphere. Examples of attempts to solve these problems are shown in the '778 patent, as well as in U.S. Pat. No. 4,699,188 (the "'188 patent"). In the '188 patent, a probe capable of piercing a cap on the water bottle is rigidly connected to the base of the support for the water bottle. The bottle cap includes a central tube with a pierceable membrane at one end of the tube. The tube is integrally formed with the bottle cap. Earlier attempts to solve problems associated with inverting a filled water bottle are shown in U.S. Pat. Nos. 4,846,236 and 4,597,423.

The system shown in the '778 patent includes a blunt probe which displaces a frangible plug integrally formed at one end of a central tube in the water bottle cap. The blunt probe of the '778 patent is equipped with means for pulling the frangible plug back into engagement with the central tube in the event that the bottle is lifted from the probe. This provides clear advantages as compared to systems in which a water bottle cap is completely removed prior to being inverted and placed on a water cooler. First, the problem of spilling water, when the bottle is initially installed, is solved, since the frangible connection remains intact and the cap remains sealed until a seal between the probe and the central tube has been achieved. Second, the plug seals the central tube automatically upon removal of the bottle from the cooler, even if the bottle is not empty. This eliminates spillage if it becomes necessary to remove the bottle from the cooler before the bottle is empty. Such removal may be necessary, for example, if repair or relocation of the cooler is required.

Finally, the resealing of the cap by the plug upon removal of an empty bottle provides protection against contamination of the empty bottle on its return trip to a water bottling facility. The inability to remove and replace the plug without the use of a probe provides the cap with a form of tamper evidency upon which bottlers can rely when deciding what kind of cleaning process to use in preparing a bottle for refilling.

However, the cap shown in the '778 patent has at least two inherent problems. First, there is a tendency for the edges of the central tube of the '778 cap to pry the plug away from its engagement with the blunt probe. When this happens, the plug does not engage the central tube and the water bottle is not sealed. This absence of a seal will result in spillage if the bottle is removed before it is empty, and in the loss of contamination protection for its return trip to the water bottling facility.

Another problem associated with the cap shown in the '778 patent is the difficulty of molding or constructing the cap as it is shown in the '778 patent. The cap has a combination of undercuts which make it impossible to mold the cap in one entire piece. Unless the cap is assembled from two pieces, such as those shown in FIG. 8 of the '778 patent, a situation known as "trapped steel" will occur, which prevents the cap from being removed from a mold without destroying the cap. The presence of the multiple undercuts and the criticality of molding the frangible connection between the plug and the central tube in the cap requires that the cap of the '778 patent be initially formed of two components. Those components must subsequently be welded or otherwise bonded together to form a single unitary cap. The welding or bonding operation is somewhat problematic in that the connection between the two components must not only be structurally sound, but must form a seal. In addition, the heat generated by a sonic-welding operation may detrimentally affect the frangible connection by lowering the breaking point of that connection. Maintaining a predictable and consistent breaking point for the frangible connection is required to ensure that the blunt probe fully engages the plug prior to breaking of the frangible connection.

A further problem associated with manufacture of the cap shown in the '778 patent relates to the handling of the component which contains the frangible connection. In order to weld the two components which comprise the cap, the portion containing the central tube and the plug frangibly connected thereto must be fed or otherwise conveyed to a position in which it can be welded to the remaining part of the cap. Handling operations must be done carefully so as not to prematurely break or weaken the frangible connection. If the frangible connection is weakened or otherwise improperly formed, the plug may have a tendency to leak or prematurely break free from the central tube of the cap before a secure connection between the plug and the probe has been achieved. When this occurs, the plug will come floating to the surface of the water in the bottle. This is a highly undesirable condition referred to as creating a "floater". The surface of the water is a highly visible location in most cooler/bottle arrangements, and users of the system do not like to see pieces of plastic floating in the water they are about to drink. Creating a "floater" also has the earlier discussed disadvantages of spillage upon early removal of the bottle, and the lack of a seal for the bottle's return trip to the bottling facility.

The above described problems and disadvantages are overcome by a cap for bottles used in water cooler systems which includes a main outer cap and an inner cap. The inner cap forms a seal on the outside surface of a central tube carried by the outer cap. Further, by causing the inner cap to seal against the outside surface of the central tube, the tendency for the inner cap to prematurely disengage from the probe is greatly reduced.

A cap of the present invention is comprised of two parts. The first part is an outer, or main, cap body, and is comprised of a generally cylindrical skirt and a central tube joined to and integrally formed with the skirt by an annular base. The central tube is equipped with external retaining means in the form of a circumferential bead formed on the outer surface of the central tube. The second part of the cap is an inner cap which is comprised of two generally cylindrical concentric sleeves, a guide sleeve and a sealing sleeve, joined by an inner cap base. The guide sleeve is smaller in diameter but longer in axial length than the sealing sleeve. The sealing sleeve has retaining means in the form of a circumferential bead formed on its inside surface. The bead on the sealing sleeve cooperates with the external bead on the central tube of the first component of the cap. The guide sleeve has a tapered free end which facilitates insertion of the guide sleeve into the central tube. The guide sleeve ensures proper concentric alignment of the sealing sleeve with respect to the central tube, thus enhancing the reliability associated with resealing of the central tube when the bottle is removed from the cooler. Splines or axial channels are formed on the outside surface of the guide sleeve to prevent buildup of pressure in the space between the two sleeves as the cap is placed into engagement with the central tube. The inside edge of the free end of the guide sleeve is equipped with means for engaging and being retained by a blunt probe having a retaining groove formed thereon. The annular base of the main cap is provided with a recess into which is placed a removable protective label which prevents the inside of the guide sleeve and the inside of the central tube from becoming dirty during shipment of bottles equipped with caps of the present invention.

In two alternative embodiments, an inner cap, without a guide sleeve, is attached to the outer surface of the central tube as in the previously described embodiment. In one of the two alternative embodiments, a probe adapter is used to form a connection between the inner cap and the probe. The probe adapter and the inner cap have cooperating male and female connecting elements, and the adapter engages and is held by a circumferential groove at the upper end of the probe. The male and female connecting elements on the inner cap and adapter, respectively, are preferably in the form of a set of resilient fingers extending downward from the center of the underside of the top of the inner cap. The fingers engage and are held by an aperture in the top of the adapter.

In another embodiment, a retention recess by which the inner cap engages and is held by the probe is similar to the configuration of the recess formed by the guide sleeve discussed above, but the recess is axially displaced to an elevation above the portion of the inner cap which seals against the outer surface of the central sleeve of the outer cap.

These and other features and advantages of the invention will be better understood upon a reading of the following detailed description of the invention read in conjunction with the accompanying drawings, wherein:

BRIEF DESCRIPTION OF THE DRAWINGS

FIG. 1 is a sectional view showing a cap of the present invention installed on a container neck;

FIG. 2 is a bottom plan view of the cap shown in FIG. 1;

FIG. 3 is an enlarged sectional view showing a portion of the inner cap of the present invention just prior to its engagement with the central tube.

FIG. 7 is a bottom plan view of an alternative embodiment of the cap of the present invention; and FIG. 8 is a sectional view of the cap shown in FIG. 7, together with a sectional view of the probe.

DETAILED DESCRIPTION OF THE INVENTION

Figure 6:
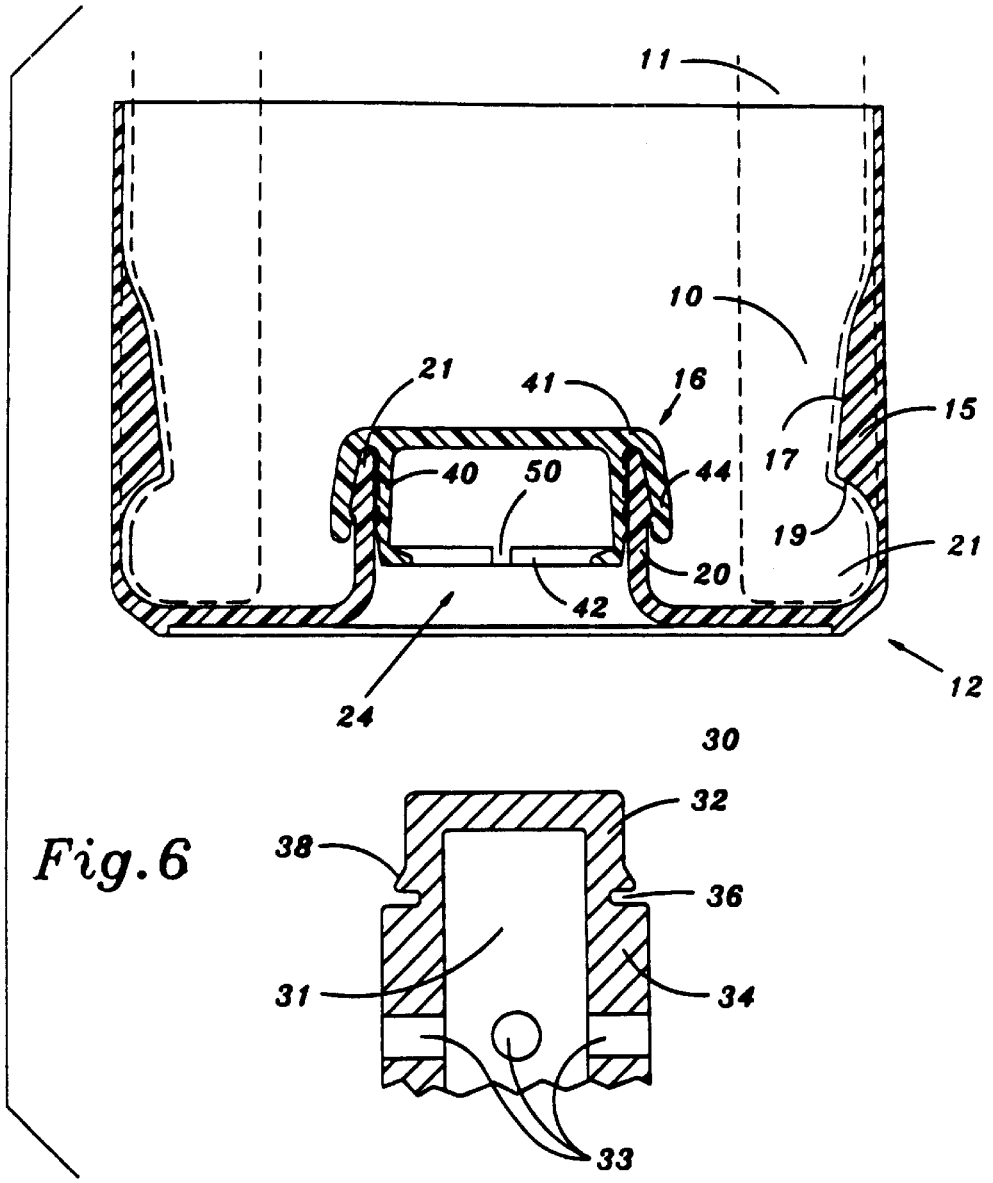
FIG. 6 is an enlarged sectional view showing the cap of the present invention, together with a probe, just prior to or after the cap's engagement with a probe.
Figure 5:
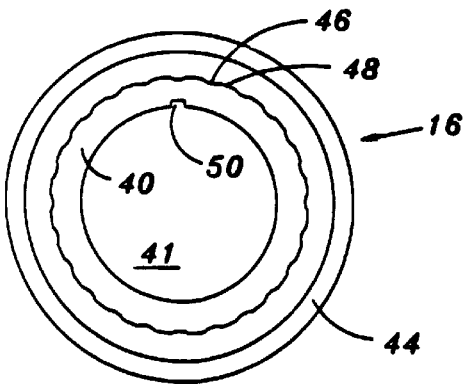
FIG. 5 is a bottom plan view of the inner cap shown in FIG. 4.
Figure 4:
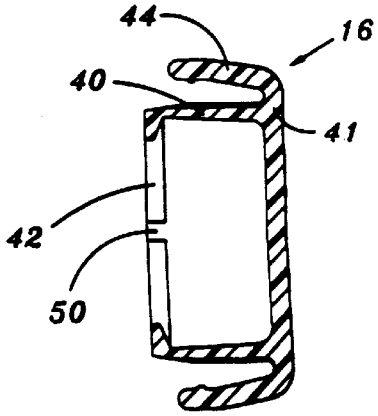
FIG. 4 is a sectional view of the inner cap component of the present invention.

FIG. 1 shows a container 11 with a bottle neck 10 onto which has been placed a cap 12 of the present invention. The cap 12 is comprised of two components, an outer cap 14 and an inner cap 16. The outer cap 14 has a skirt 18, and a central tube 20 joined to the skirt 18 by an annular base 22. The annular base 22 and the central tube 20 define a main passageway 24 through which fluid is intended to flow after the inner cap 16 is lifted from the central tube 20 by a probe 30 (See FIG. 6). A protective label 26 with a pull-tab 28 is placed on the outer surface of the annular base 22. The protective label 26 prevents dirt from coming into contact with the central tube 20 and the inside of the inner cap 16. The inner cap 16 is comprised of a guide sleeve 40 and a sealing sleeve 44 joined to the guide sleeve 40 by an inner cap base 41.

FIG. 2 is a bottom plan view of the cap of the present invention. The intermittent lugs 15 engage a circumferential recess formed in the upper portion of a water bottle neck to retain the cap firmly on a container. As can best be seen in FIG. 6, each lug 15 is comprised of a ramping surface 17 and a shorter arcuate surface 19 which abuts a bead 21 formed in the top of the bottle neck 10.

FIG. 6 is an enlarged sectional view showing the cap 12 of the present invention just prior to its placement over a blunt probe 30. The probe 30 includes an upper section 32 and a lower section 34 with a groove 36 therebetween. A conical portion 38 on the upper section 32 lies just above the groove 36. As the cap 12 is lowered into contact with the probe 30, the upper section 32 enters the passageway 24 and fits within a guide sleeve 40, which is part of the inner cap 16. A bead 42 at the free end of the guide sleeve 40 is spread by the conical section 38 and enters the groove 36 when the upper section 32 fully enters the guide sleeve 40. Upon further lowering of the cap 12, the sealing sleeve 44 of the outer cap 14 disengages from the central tube 20. As the inner cap 16 disengages from the central tube 20, the inside surface of the central tube 20 seals against the outside surface of the lower section 34 of the probe 30. Upon further lowering of the cap 12 over the probe 30, the uppermost edge 21 of the central tube 20 moves past and below the openings 31. At that point, the inside of the container 11 is in fluid communication with the hollow interior 33 of the probe 30.

When substantially all of the contents of the container 11 have passed from the container 11 through the openings 31 and through the hollow interior 33, the container 11 can then be lifted from the probe 30. When the container 11 is lifted, the inner cap 16 is brought back into engagement with the central tube 20. The sealing sleeve 44 sealingly engages the outside surface of the central tube 20. To prevent the buildup of pressure in the space between the sealing sleeve 44 and the guide sleeve 40, the outside surface of the guide sleeve 40 is equipped with longitudinal channels 46 separated by splines 48. As an alternative to the channels 46 and the splines 48 on the guide sleeve 40, the upper part of the inside of the central tube 20 could be equipped with a channel or a series of channels to prevent the buildup of pressure in the space between the guide sleeve 40 and the sealing sleeve 44. Yet a further alternative would be to provide a single channel on the guide sleeve. Similarly, to prevent buildup of pressure on the inside of the guide sleeve 40 as the upper section 32 of the probe 30 becomes seated in the inner cap 16, a small break 50 is formed in the bead 42 on the free end of the guide sleeve 40. Alternatively, a series of breaks could be used to prevent the buildup of pressure within the inner cap 16.

To ensure that the inner cap 16 is securely engaged around the upper section 32 of the probe 30 before the sealing sleeve 44 begins to disengage from the outer surface of the central tube 20, the force required to push the bead 42 over the conical surface 38 into the groove 36 should be substantially less than the force required to disengage the bead 52 on the inside surface of the sealing sleeve 44 from the bead 54 on the outside surface of the central tube 20. FIG. 3 shows the positioning of the beads 52 and 54 in greater detail.

Achieving the proper relationship between the force required to attain engagement between the probe 30 and the inner cap 16, on the one hand, and the force required to disengage the outer cap 14 from the central tube 20, on the other hand, is important for proper performance of the cap of the present invention. The force required to engage the probe 30 with the inside of the inner cap 16 must be substantially less than the force required to lift the inner cap 16 from the central tube 20. If this force relationship is not properly maintained, placement of the cap 12 over the probe 30 may result in the inner cap 16 failing to become engaged and held by the probe 30, thus becoming a "floater". A "floater" occurs when the inner cap 16 is pushed out of engagement with the central tube 20 before the bead 42 engages the groove 36 on the probe 30. If this were to occur, the inner cap 16 would come floating to the top of the liquid in the container. The presence of the guide sleeve 40 and the inwardly tapered surface on the free ends 43 (lower end in FIG. 3) reduces the tendency for the inner cap to become a "floater".

Also important to the proper performance of the cap of the present invention is the relationship between the force required to cause re-engagement of the sealing sleeve 44 with the central tube 20 and the force required to disengage the guide sleeve 40 from the upper section 32 of the probe 30. The force required to cause the bead 52 to move past the bead 54 as the cap 12 is lifted from the probe 30 must be substantially less than the force required to disengage the bead 42 from the groove 36. The absence of this relationship will result in the inner cap 16 being loose inside the container when the empty container is lifted off the probe 30. If the probe 30 is capable of disengaging from the inside of the guide sleeve 40 before the bead 52 moves past the bead 54, the inner cap 16 will be free to fall off of the central tube 20, and the passageway 24 will not be sealed on the container's return trip to the water bottling facility.

The gradual slope of the conical surface 56 adjacent to the bead 54, as shown in FIG. 3, makes it easy to obtain positive engagement of the beads 52 and 54. The inward (to the left in FIG. 3) resilience of the sealing sleeve 44 urges the central tube 20 inward. Pushing of the central tube 20 radially inward tends to increase the force required to cause the bead 42 to move out of the groove 34. The inwardly resilient action of the sealing sleeve 44 also contributes to the formation of a water-tight seal between the beads 52 and 54, and between the surface 56 on the central tube 20 and the inside surface 58 on the sealing sleeve 44. The inside surface 58 of the sealing sleeve 44 is shaped to fit snugly against the conical surface 56 when the sealing sleeve 44 is flexed outwardly to receive the upper part of the central tube 20. Thus, the cap 12 is designed so that a seal is formed between the inner cap 16 and the central tube 20 on the outside of the central tube 20. As used herein, reference to the outside of the central tube 20 is meant to include the upper surface of the free end of the central tube 20, which in the preferred embodiment is rounded to seal against a matching rounded surface at the inside of the inner cap base between the guide sleeve 40 and the sealing sleeve 44. It is possible than an effective seal between the inner cap 16 and the central tube 20 could be made by forming a seal only between the upper surface of the free end of the central tube 20 and the base of the inner cap 16 between the guide sleeve 40 and the sealing sleeve 44, only on a portion of the generally axially oriented part of the outside of the central tube 20. In such a situation, the seal between the inner cap 16 and the central tube 20 would be located only on the upper surface of the free end of the central tube 20, and that surface could include a sealing bid or other formation to enhance the seal forming ability of the surface.

The arrangement of the locking means and surfaces of the cap of the present invention enables the cap 12 to have well defined differentials between the connection and disconnection forces involved in replacing the inner cap 16 on the central tube 20 prior to and after engagement of the probe 30 with the inner cap 16.

FIGS. 7 and 8 show an alternative embodiment of the cap of the present invention. Numbers corresponding to the embodiment discussed with respect to FIG. 1 through 6 have been used to make reference to the alternative embodiment with the supplemental reference letter "a" added.

FIG. 7 is a plan view and FIG. 8 is a sectional view of the alternative cap 12*a*. Probe 30*a* also differs from the probe discussed earlier, primarily in its internal characteristics. The probe 30*a* has a groove 36*a* and openings 31*a*. However, the probe 30*a* allows a small stream of air to enter the container through an air channel 33*a* when water flows out of the container through the central channel 35*a*. The cap 12*a* includes a pull-tab 60*a* which is used to remove the cap 12*a* from a bottle, preferably by a bottler after the bottle has made a return trip to the bottler's facility for refilling. The pull-tab 60*a* is adjacent to a scoreline 62*a*, which extends from the bottom edge of the skirt 18*a* through the circumferentially extending ramp 17*a*. A scoreline 64*a* then continues partially around the circumference of the cap 12*a* between the ramp 17*a* and a circumferential bead 19*a* which engages a recess on the upper portion of a bottle neck to hold the cap 12*a* in place. Except for the interruption caused by the scoreline 62*a*, the ramp 17*a* is continuous around the inside surface of the skirt 18*a*. A seal 66*a* is disposed in the cap 12*a* between the skirt 18*a* and the central tube 20*a*. The seal 66*a* is held in place by a small inwardly directed bead 68*a* which frictionally engages the outside edge of the seal 66*a*. It should be noted that an initially fluid compound which subsequently sets up and adheres to the inside of the cap could be used in lieu of the seal 66*a*, in which case the bead 68*a* may or may not be included.

The cap 12*a*, like the cap 12 shown in FIGS. 1 through 6, includes an inner cap 16*a* which engages a central tube 20*a*. The central tube 20*a*, and the components of the inner cap 16*a* are substantially identical to the central tube and inner cap of FIGS. 1 through 6, both in shape and in the way they perform.

Proper performance of the cap of the present invention is dependent on two key relationships. The first is the relationship between the force required to achieve a positive connection at the probe/inner cap interface and the force required to disengage the inner cap 16 from the central tube 20. The second key relationship is the differential between the force required to achieve a positive connection at the inner cap/central tube interface and the force required to disengage the probe 30 from the inner cap 16. The cap of the present invention 12 allows for proper design of these relationships by physically separating the location of the components which determine these forces and the resulting differentials. Specifically, the means by which the inner cap 16 is held in place on the central tube 20 is physically separated from the means by which the inner cap 16 is retained by the probe 30. Also significant is the fact that the seals required for proper functioning of the cap of the present invention are also physically separated. The seal between the lower section 34 of the probe 30 is on the inside surface of the central tube 20. In contrast, the seal between the inner cap 16 and the outer cap 14 is located on the outside surface of the central tube 20. Thus, these seals are more effective because they involve separate and distinct physical components which are not directly interrelated.

Figure 9:
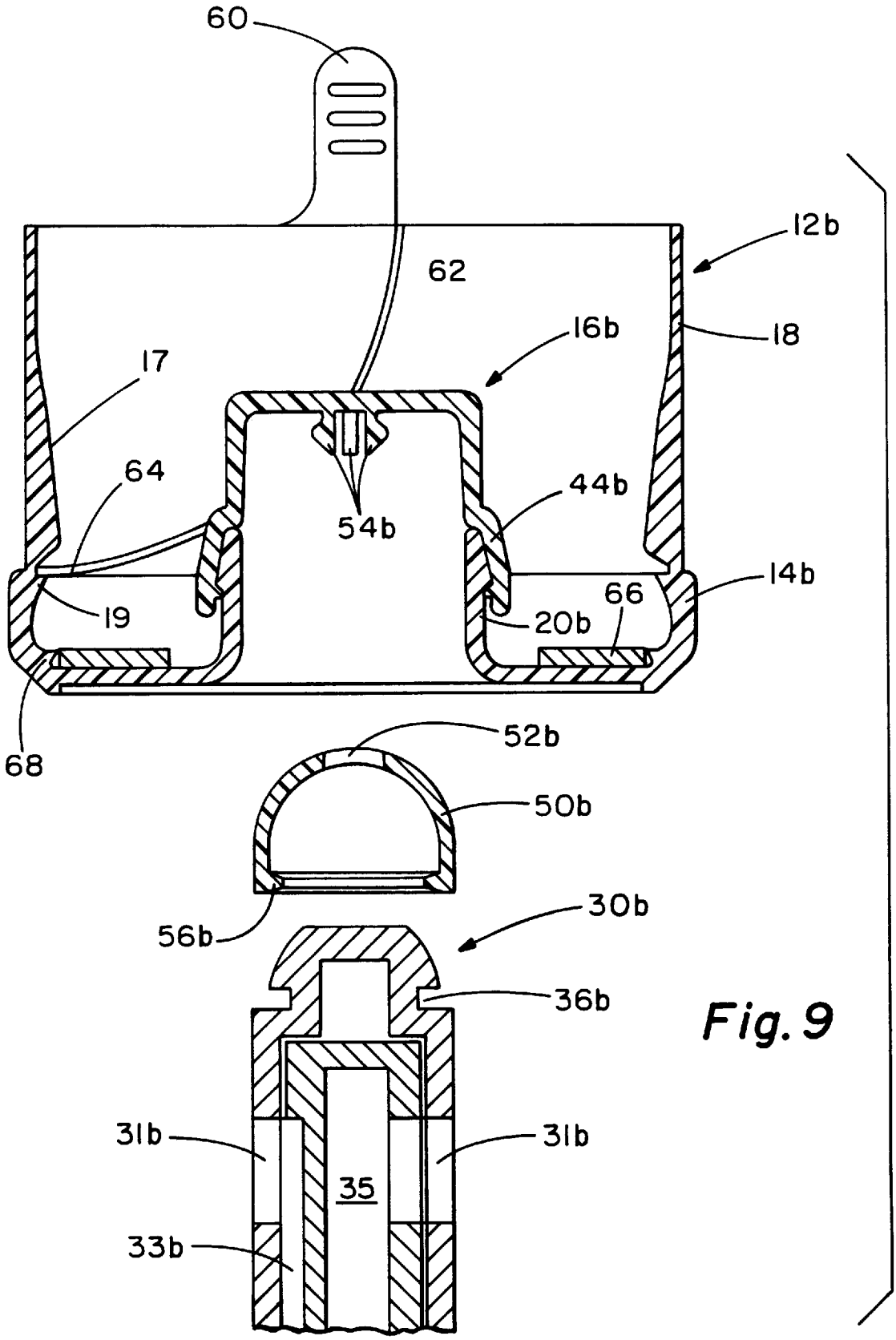
FIG. 9 is an exploded sectional view of another alternative embodiment of the cap of the present invention, together with a probe and an adapter.

FIG. 9 is another embodiment of the present invention in which the two connections, i.e. the connection of the inner cap 16*b* to outer cap 14*b* and the connection of the inner cap 16*b* to the probe 30*b*, are even further separated from each other, as compared to the earlier described embodiments. In describing the embodiment of FIG. 9, the alphabetic suffix "b" has been added to the reference numerals; parts in this figure which are similar to earlier figures have reference numerals with the same numeric prefix.

In FIG. 9, the sealing sleeve 44*b* fits over and seals against the outer surface of the central tube 20*b*. An adapter 50*b*, which snaps into engagement with the probe 30*b*, is a dome-shaped extension of the probe. The adapter may be made of stainless steel or other metal, or may be made of plastic. It must, however, be relatively difficult to remove and must be at least more difficult to remove from the probe than the inner cap is to remove from the adapter. Otherwise, removal of the dispenser might cause removal of the adapter from the probe, rather than the intended result, which is a sequence whereby reconnection of the inner cap to the central tube occurs first, followed by disconnection of the inner cap from the adapter without any disconnection of the adapter from the probe.

An aperture 52*b* is of a shape such that the fingers 54*b*, which extend from the inside of the inner cap 16*b*, are retained by the aperture 52*b* when the cap 12*b*, including the inner cap 16*b*, is lowered onto the probe/adapter assembly. As the cap 12*b* is lowered onto the probe 30*b* (with the adapter 50*b* attached thereto by engagement of the rib 56*b* with the groove 36*b*), the fingers 54*b* deflect and are engaged by the edges of the aperture 52*b*. This engagement occurs prior to the disengagement occurs prior to the disengagement of the sealing sleeve 44*b* from the central tube 20*b*. As the cap 12*b*, and the bottle (not shown) for which it is a closure, continues to be lowered over the probe 30*b* and the adapter 50*b*, the inner cap is lifted away from the central tube 20*b* in an axial direction. Eventually, the central tube 20*b* slides past, i.e. below in FIG. 9, the openings 31*b* so that the openings 31*b* are in fluid communication with the interior of the container to which the cap 12*b* is attached.

When the container is empty and is lifted from the dispenser of which the probe 30*b* is a part, the cap 12*b* begins an upward movement such that the seal between the sleeve 44*b* and the central tube 20*b* is re-formed and a connection between these two components is re-established, as in the manner shown in FIG. 3 with respect to first described embodiment of the invention. As the container is further lifted, the fingers 54*b* are disengaged from the aperture 52*b*. The adapter 50*b* remains attached to the probe 30*b*, and the empty container is re-sealed for its return trip to the bottling facility.

Figure 10:
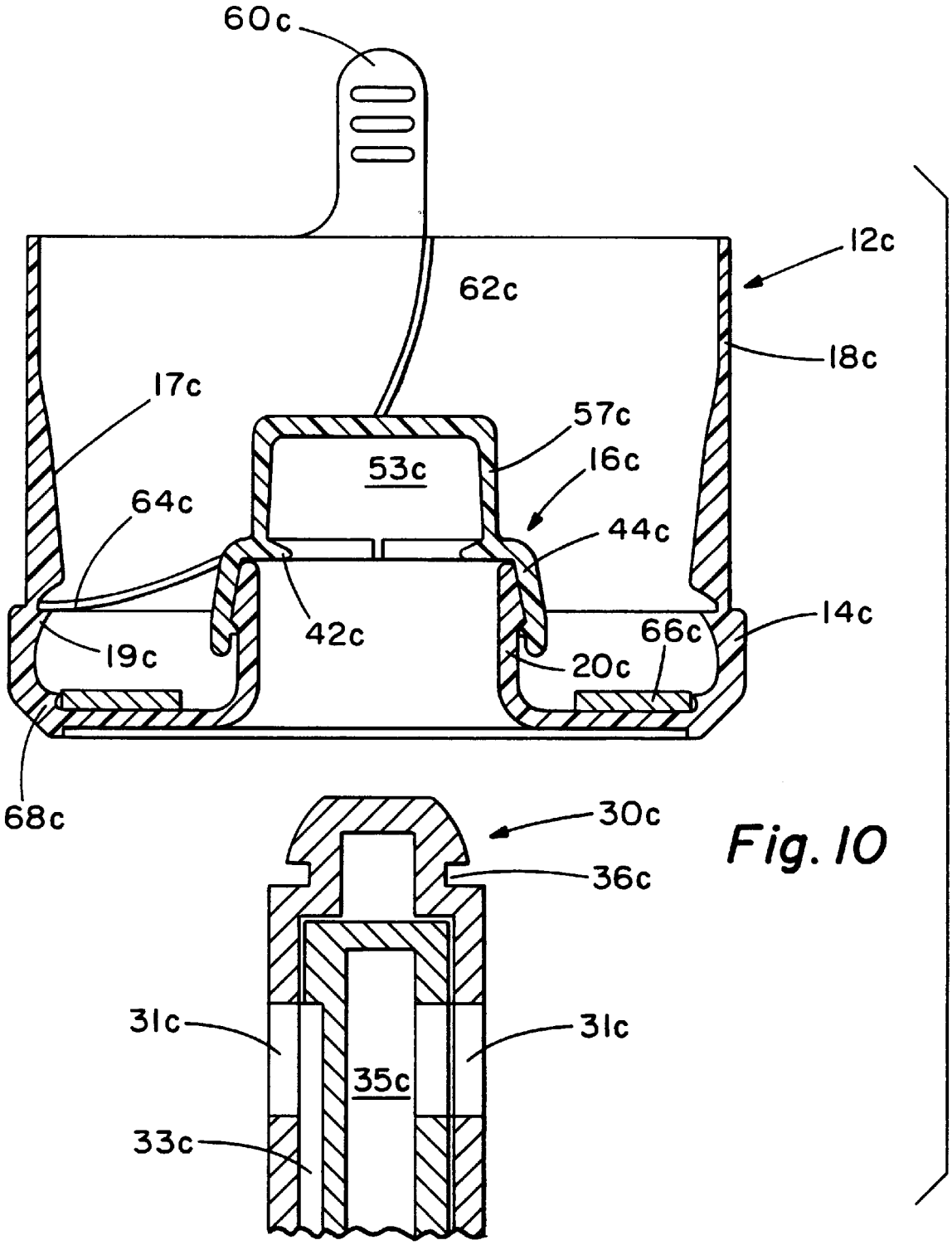
FIG. 10 is an exploded sectional view of a further alternative embodiment of the cap of the present invention, together with a probe and an adapter.

FIG. 10 is a further alternative embodiment of the present invention. The reference numerals in this figure have an alphabetic suffix "c" to distinguish them from earlier but similar embodiments of the invention. In this embodiment, the inner cap 16*c* is similar to the inner cap of the embodiment in FIGS. 1 through 8, but differs therefrom in that there is no guide sleeve. Instead, the structure of the guide sleeve is axially displaced (upwardly in FIG. 10) to form a recess 53*c*. A rib 42*c* extends inwardly at the juncture of the upper wall 57*c* and the sealing sleeve 44*c*. The rib 42*c* engages and holds the inner cap 16*c* on the probe 30*c* when the cap 12*c* is lowered onto the probe 30*c*.

As is the case with earlier described embodiments, the inner cap 16*c* first engages the probe 30*c*, and the rib 42*c* snappingly engages the groove 36*c* formed in the probe 30*c*, when the container carrying the cap 12*c* is first installed on a dispenser of the type having a probe, such as the probe 30*c*. As the container is allowed to be further lowered, and after the rib 42*c* is positioned in the groove 36*c*, the central tube 20*c* is withdrawn from its sealing engagement with the sealing sleeve 44*c*, and the interfering connection formed by the beads formed on the outer surface of the central tube 20*c* and the inside surface of the sealing sleeve 44*c*. See FIG. 3 and the discussion of that figure for the details of the connection between the central tube 20*c* and the sealing sleeve 44*c*.

As the container and the cap 12*c* continues to move downward, the inner cap 16*c* is lifted away from the central tube 20*c* and the central tube 20*c* slides past the openings 31*c* in the probe 30*c* placing the passageway 35*c* in fluid communication with the interior of the container carrying the cap 12*c*.

When the container is empty, it is lifted and the connection between the central tube 20*c*and the sealing sleeve 44*c* is re-made. This re-connection occurs before the subsequent disengagement of the rib 42*c* from the groove 36*c*. That is, only after the central tube 20*c* is re-positioned into sealing engagement with the sealing sleeve 44*c* will the rib 42*c* release its grip on the probe 30*c*. As the container carrying the cap 12*c* is lifted away from the probe 30*c*, inner cap 16*c* and the outer cap 15*c* are re-connected in a sealed manner to protect the interior of the container from contamination for the return trip for a refilling operation.

While specific embodiments of the invention have been shown and described, it will be apparent to those skilled in the art that numerous alternatives, modifications, and variations of the embodiments shown can be made without departing from the spirit and scope of the appended claims. In particular, the invention has been described with frequent reference to its application in the field of dispensing water. Those skilled in the art will recognize that the invention described herein is applicable to dispensing systems used in other applications such as dispensing edible oils and flowable dry material.

We claim:

1. A cap for seal a container, said cap comprising an outer cap and an inner cap, said outer cap comprising a cylindrical skirt with at least one container gripping formation on an inside surface of said skirt for engaging a corresponding formation on a neck of said container, a tube generally cylindrical in shape and generally parallel to and concentric with said skirt, said tube and said skirt being joined by an annular base, said annular base surrounding an axial passageway extending through said base and through said tube, said inner cap comprising a sealing sleeve, said sealing sleeve fitting over and sealing against an outside surface of said tube, and a second sleeve adapted to engage a probe and hold said inner cap in a position adjacent to said probe.

2. A cap in accordance with claim 1 wherein:

said second sleeve includes a bead formed on an inner surface of said inner cap.

3. A cap in accordance with claim 2 wherein:

said second sleeve has at least one protrusion extending inwardly from an inside surface of said second sleeve, said protrusion being adapted to engage and retain said inner cap in close proximity to said probe when said inner cap is separated from said tube.

4. A cap in accordance with claim 1 wherein:

said sealing sleeve and said second sleeve have differing diameters, a first cylindrical section of said second sleeve having a closed end and defining a fist recess for receiving a tip of a probe, said sealing sleeve having a second cylindrical section defining a second recess larger in diameter than said fist recess, said second recess being formed by said sealing sleeve.

5. A cap in accordance with claim 4 wherein:

said inner cap has an internally directed protrusion, said protrusion being a radially inwardly extending and at least partially circumferential rib located at an end of said second sleeve, said rib fitting closely into an annular groove in a probe.

6. A cap in accordance with claim 5 wherein:

said sealing and second sleeves are coaxially disposed and axially displaced with respect to each other, said rib being disposed at a juncture of said first and second recesses.

7. A closure and probe combination for dispensing flowable substances from a container, said combination including a probe used to remove contents of said container and a closure comprising an outer cap and an inner cap, said outer cap comprising a cylindrical skirt with a container gripping formation on an inside surface of said skirt for engaging a corresponding formation on an outside surface of a neck of said container, a tube generally cylindrical in shape and generally parallel to and concentric with said skirt, said tube and said skirt being joined by an annular base, said annular base surrounding an axial passageway extending through said base and through said tube, said inner cap comprising a sealing sleeve, said sealing sleeve fitting over and sealing against an outside surface of said tube, and a second sleeve in said inner cap which engages and retains said inner cap in a position adjacent to said probe.

8. A closure and probe combination in accordance with claim 7 wherein said sealing sleeve is larger in diameter than said second sleeve.

9. A closure and probe combination in accordance with claim 8 wherein said probe is equipped with an adapter, and said inner cap has at least one protrusion extending downwardly from an inside surface of said inner cap, said adapter having an opening shaped to receive and retain said at least one protrusion and thereby hold said inner cap in proximity to said probe after said inner cap is separated from said tube.

10. A closure and probe combination in accordance with claim 8 wherein said inner cap has at least one inwardly extending protrusion formed on an inside surface of said inner cap, said protrusion being engagable with a portion of said probe so as to be useable to hold said inner cap to said probe after said inner cap is separated from said tube.

11. A closure and probe combination in accordance with claim 8 wherein said second sleeve is substantially within said sealing sleeve.

12. A closure and probe combination in accordance with claim 8 wherein said second sleeve is an extension of and axially offset with respect to said sealing sleeve.

13. A cap for sealing a container, said cap comprising an outer cap and an inner cap, said outer cap comprising a cylindrical skirt with at least one gripping formation on an inside surface of said skirt for engaging a corresponding formation on the neck of a container, a tube generally parallel to and concentric with said skirt, said tube and said skirt being joined by an annular base, said annular base surrounding an axial passageway extending through said base and through said tube, said inner cap comprising two generally concentric sleeves, a first sealing sleeve and a second probe-engaging sleeve, said first sealing sleeve fitting over sealing against an outside surface of said tube, and said second sleeve having at least one probe engaging formation useable to hold said inner cap in a position adjacent to a free end of said probe, said first sealing sleeve and said second probe-engaging sleeve having differing transverse dimensions, one end of said second sleeve having a closed end and defining a recess for receiving a tip of a probe, and said sealing sleeve defining a second recess axially offset with respect to said first recess and shaped to receive a free end of said tube.

* * * * *